US007058352B2

(12) United States Patent
Ozawa et al.

(10) Patent No.: US 7,058,352 B2
(45) Date of Patent: Jun. 6, 2006

(54) IMAGE FORMING APPARATUS

(75) Inventors: Toru Ozawa, Saitama (JP); Manabu Saito, Saitama (JP); Michiaki Yoshida, Niigata (JP); Minoru Satoh, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/383,249

(22) Filed: Mar. 7, 2003

(65) Prior Publication Data

US 2004/0047662 A1 Mar. 11, 2004

(30) Foreign Application Priority Data

Sep. 6, 2002 (JP) ..... P. 2002-261910
Sep. 20, 2002 (JP) ..... P. 2002-275005

(51) Int. Cl.
*G03G 15/00* (2006.01)

(52) U.S. Cl. ..... 399/392; 399/393

(58) Field of Classification Search ..... 399/388, 399/390, 391, 392, 393; 271/9.01, 9.02
See application file for complete search history.

(56) References Cited

U.S. PATENT DOCUMENTS 4,204,668 A * 5/1980 Yanagawa ..... 271/9.02
4,392,740 A * 7/1983 Ito et al. ..... 399/21
4,766,467 A * 8/1988 Yamada et al. ..... 399/110
5,040,019 A * 8/1991 Ito ..... 355/50
6,496,281 B1 * 12/2002 Yamamoto et al. ..... 358/401

FOREIGN PATENT DOCUMENTS

JP 3-186535 8/1991
JP 2001-2282 1/2001

* cited by examiner

*Primary Examiner*—Ren Yan
(74) *Attorney, Agent, or Firm*—Morgan, Lewis & Bockius LLP

(57) ABSTRACT

A paper feed cassette or a paper transporting unit is selectively inserted into an image forming apparatus body. A manual paper feed unit is coupled to the paper transporting unit. A recording medium is fed out of the manual paper feed unit, passes through the paper transporting unit and reaches a main transporting path in the image forming apparatus body. An image is formed on the recording medium by image forming unit disposed in the main transporting path.

10 Claims, 17 Drawing Sheets

IMAGE FORMING APPARATUS

The present disclosure relates to the subject matter contained in Japanese Patent Application No.2002-261910 filed on Sep. 6, 2002 and Japanese Patent Application No.2002-275005 filed on Sep. 20, 2002, which are incorporated herein by reference in its entirety.

BACKGROUND OF THE INVENTION

1. Field of the Invention

The present invention relates to an image forming apparatus with au automatic paper feeder.

2. Description of the Related Art

There are known a variety of automatic paper feeders for an image forming apparatus such as a paper feed cassette, a manual paper feed unit, and a multi-sheet inserter. An image forming apparatus having this type of an automatic paper feeder is known in which a paper feed cassette and a multi-sheet inserter are detachably attached to a body of the image forming apparatus (JP-A-2001-2282, paragraph 0020 and FIG. 2). In the image forming apparatus, sheets having a fixed form size are stacked in the paper feed cassette. Sheets having an unfixed form size are stacked in the multi-sheet inserter. Sheets stacked are successively fed to an image forming unit at a timings of operation of the image forming unit, images are formed on the sheets by the image forming unit, and the sheets having images thereon are discharged.

In the image forming apparatus according to the related art, the paper feed cassette and the multi-sheet inserter are attached to different portions of the image forming apparatus body, respectively. Accordingly, even if no multi-sheet inserter is needed, a space of the portion for receiving the multi-sheet inserter must be secured. As a result, the size reduction of the image forming apparatus is hindered. This is a proble.

SUMMARY OF THE INVENTION

Accordingly, an object of the present invention is to provide an image forming apparatus with an automatic paper feeder in which a size of the image forming apparatus is reduced by effectively utilizing a space of a portion of the apparatus to which a paper feed cassette is attached.

According to a first aspect of the invention, there is provided an image forming apparatus including an image forming apparatus body, an paper feed cassette detachably attached to the image forming apparatus body, and a paper transporting unit, which is be detachably attached to the image forming apparatus body in place of the paper feed cassette. Accordingly, the paper feed cassette is drawn out of the image forming apparatus body and then, the paper transporting unit can be attached instead.

According to a second aspect of the invention, there is provided an image forming apparatus including an image forming apparatus body, a paper transporting unit detachably attached to the image forming apparatus body, and a paper feed cassette, which is be detachably attached to the image forming apparatus body in place of the paper transporting unit. Accordingly, the paper transporting unit is drawn out of the image forming apparatus body and then, the paper feed cassette can be inserted instead.

According to a third aspect of the invention, there is provided an image forming apparatus including an image forming apparatus body. A paper feed cassette and a paper transporting unit are interchangeable with each other with respect to the image forming apparatus body. Accordingly, user can desirably attach the paper feed cassette or the paper transporting unit into the image forming apparatus body.

The paper transporting unit may merely form a transporting path through with recording medium passes. However, it is preferable that the paper transporting unit includes a transporting roll for transporting the recording medium.

The paper transporting unit can be coupled to various types of paper supplying units. For example, the paper transporting unit can be coupled to a manual paper feed unit. The manual paper feed unit is preferably fixed to the image forming apparatus body. When the manual paper feed unit is provided, the recording medium delivered from the manual paper feed unit can be supplied to the image forming apparatus body via the paper transporting unit. The transporting roll of the paper transporting unit can be driven by a drive source provided in the manual paper feed unit or a drive source provided in the image forming apparatus body.

The manual paper feed unit may include a sheet stacking tray for stacking recording medium thereon, and a feeding roll for feeding the recording medium stacked on the sheet stacking tray. The recording medium may be fed to the paper transporting unit by rotating the feeding roll. The sheet stacking tray is preferably rotatable about the feeding roll. Further, the sheet stacking tray preferably expands and contracts in size in accordance with a size of the recording medium.

The paper transporting unit may be coupled to a large capacity tray. The recording medium may be supplied from the large capacity tray to the image forming apparatus body via the paper transporting unit.

A post-processor such as a sorter may be coupled to the paper transporting unit. In this case, the paper transporting unit serves as a transporting unit for discharging recording medium. The recording medium, which is returned by a reverse transporting path for both-side recording, is led to the paper transporting unit and the recording medium is fed to the post-processor from the paper transporting unit.

In addition, in the invention, a paper feed cassette and a particular paper feed unit are interchangeable with each other with respect to the image forming apparatus body. The particular paper feed unit is, for example, an envelope feeder for feeding paper having a special size such as an envelope. The replaceable position is not limited to a specific position in particular, but may be a position of any of the paper feed cassettes of the image forming apparatus body. The paper feed cassette at the upper most stage is preferable in order to secure easy operation.

According to a fourth aspect of the invention, there is provided a paper feed unit including a paper feed unit body, a paper feed cassette detachably attached to the paper feed unit body, and a manual paper feed unit, which is detachably attached to the paper feed unit body in place of the paper feed cassette.

According to a fifth aspect of the invention, there is provided a paper feed unit including a paper feed unit body, a manual paper feed unit detachably attached to the paper feed unit body, and a paper feed cassette, which is detachably attached to the paper feed unit body in place of the manual paper feed unit.

According to a sixth aspect of the invention, there is provided a paper feed unit including a paper feed unit body. A paper feed cassette and a manual paper feed unit are interchangeable with each other with respect to the paper feed unit body.

Accordingly, when the manual paper feed unit is required, the manual paper feed unit is inserted in place of the paper feed cassette. When the manual paper feed unit is not required, the paper feed cassette is inserted in place of the manual paper feed unit. This feature eliminates a waste of space and reduces the size of the image forming apparatus.

Preferably, the manual paper feed unit includes a unit body portion and a transporting portion coupled to the unit body portion. At least a part of the transporting portion is drawably inserted into the paper feed unit body in place of the paper feed cassette.

Preferably, the unit body portion includes a paper feed tray for stacking recording medium thereon and a feed roll for manual paper feed, for feeding the recording medium from the paper feed tray to the transporting portion. The feed roll for manual paper feed is disposed at a position out of a drawing-out locus line of the transporting portion. The paper feed tray is supported so as to be movable between a paper feed position at which the stacked recording medium is fed and an avoidance position, which is out of the drawing-out locus line of the transporting portion. Accordingly, when paper jamming occurs in the transporting portion, what the user has to do is to pull out the transporting portion. The jammed paper is easily removed.

Preferably, the paper feed unit further includes a locking member for preventing the transporting portion from being drawn out till the unit body portion is attached. Thereby, user is prevented from mistakenly removing the transporting portion to secure a safety of attachment.

Preferably, the paper feed tray includes a bottom plate disposed rockably, an elastic member for urging the bottom plate toward the feed roll for manual paper feed, a movable cam for pressing the bottom plate against the elastic member when the paper feed tray is at the paper feed position, and a fixed cam for pressing the bottom plate against the elastic member when the paper feed tray is at the avoidance position. Accordingly, also when the paper feed tray is at the avoidance position, the bottom plate can remain pressed. Therefore, the paper feed tray may be moved to the avoidance position in a state that the recording medium is set without that recording medium is eliminated to move the paper feed tray to the avoidance position.

Preferably, the unit body portion includes a drive source for driving the feed roll for manual paper feed. Provision of the drive source in the unit body simplifies the drive system.

Preferably, the transporting portion includes upper and lower guide portions arranged in a vertical direction to define a manual paper feed sheet transporting path, and at least one pair of transporting rolls for transporting the recording medium coming from the unit body portion. At least one of the upper and lower guide portions is drawable. With this structure, user can easily remove recording medium jammed in the sheet transporting path Preferably, the unit body portion includes a drive source for driving the transporting roll.

The second drive force transmitting member includes a timing belt, thereby reducing the drive load. Here, a first drive force transmitting member may couples the drive source and the feed roll for manual paper feed. A second drive force transmitting member may couples the feed roll for manual paper feed and the transporting roll. The second drive force transmitting member has a coupling removal member for removing the coupling between the feed roll for manual paper feed and the transporting roll, when the transporting portion is drawn out. When the second drive force transmitting member includes a gear train, The coupling removal means may be a pendulum gear.

Also, the second drive force transmitting member may include a timing belt.

Preferably, the paper feed unit body has a body-side feed roll. The paper feed cassette has a retard roll for handling recording medium supplied from the paper feed cassette in cooperation with the body-side feed roll. The manual paper feed unit has a pinch roll contacting with the body-side feed roll. With this feature, the feed roll on the unit body may be commonly used for both the paper feed cassette and the manual paper feed unit. As a result, the number of required parts is reduced and the cost to manufacture is reduced.

the unit body portion and the transporting portion is attached to the paper feed unit body with being integrally-detachable therefrom. The paper feed unit may further includes a handle portion for integrally drawing out the unit body portion and the transporting portion. Accordingly, the manual paper feed unit may be drawn out as a whole, and its replacement with the paper feed cassette is easy.

The paper feed unit may includes a holding member for holding the unit body portion at the paper feed unit body and a holding removal member for removing the hold by the holding member. The holding removal member is preferably disposed at a place, which is not conspicuous to user, such as a bottom surface of the unit body portion. With such features, when the recording medium is jammed at the manual paper transporting path, it is prevented that the user mistakenly pulls out the unit body in place of the transporting portion.

The paper feed unit body may includes a nadger roll for feeding recording medium from the paper feed cassette, a roll support member for rockably supporting the nadger roll, and a movable member for moving the roll support member in response to insertion of the manual paper feed unit, when the manual paper feed unit is inserted. With this feature, before the manual paper feed unit is inserted, the nadger roll is rockable to provide an easy work of removing the jammed sheet. When the manual paper feed unit is inserted, the roll support member is fixed to provide a stable transporting path.

The paper feed unit may further include a first detecting member for detecting attachment of the paper feed cassette and attachment of the manual paper feed unit. The first detecting member is, for example, a microswitch, which may be used for both the paper feed cassette and the manual paper feed unit.

The paper feed unit may further include a second detecting member for detecting presence of recording medium in the paper feed cassette and attachment of the manual paper feed unit. The second detecting member is, for example, a microswitch, which may be used for both the paper feed cassette and the manual paper feed unit.

The present invention involves an image forming apparatus including the paper feed unit as described above.

BRIEF DESCRIPTION OF THE DRAWINGS

FIG. 17 is a diagram showing a structure including a second detecting member and vicinity thereof.

FIG. 20 is a diagram showing a structure including a movable cam and vicinity thereof in the manual paper feed unit according to the fifth embodiment of the invention.

DETAILED DESCRIPTION OF THE PREFERRED EMBODIMENTS (First Embodiment)

Figure 1:
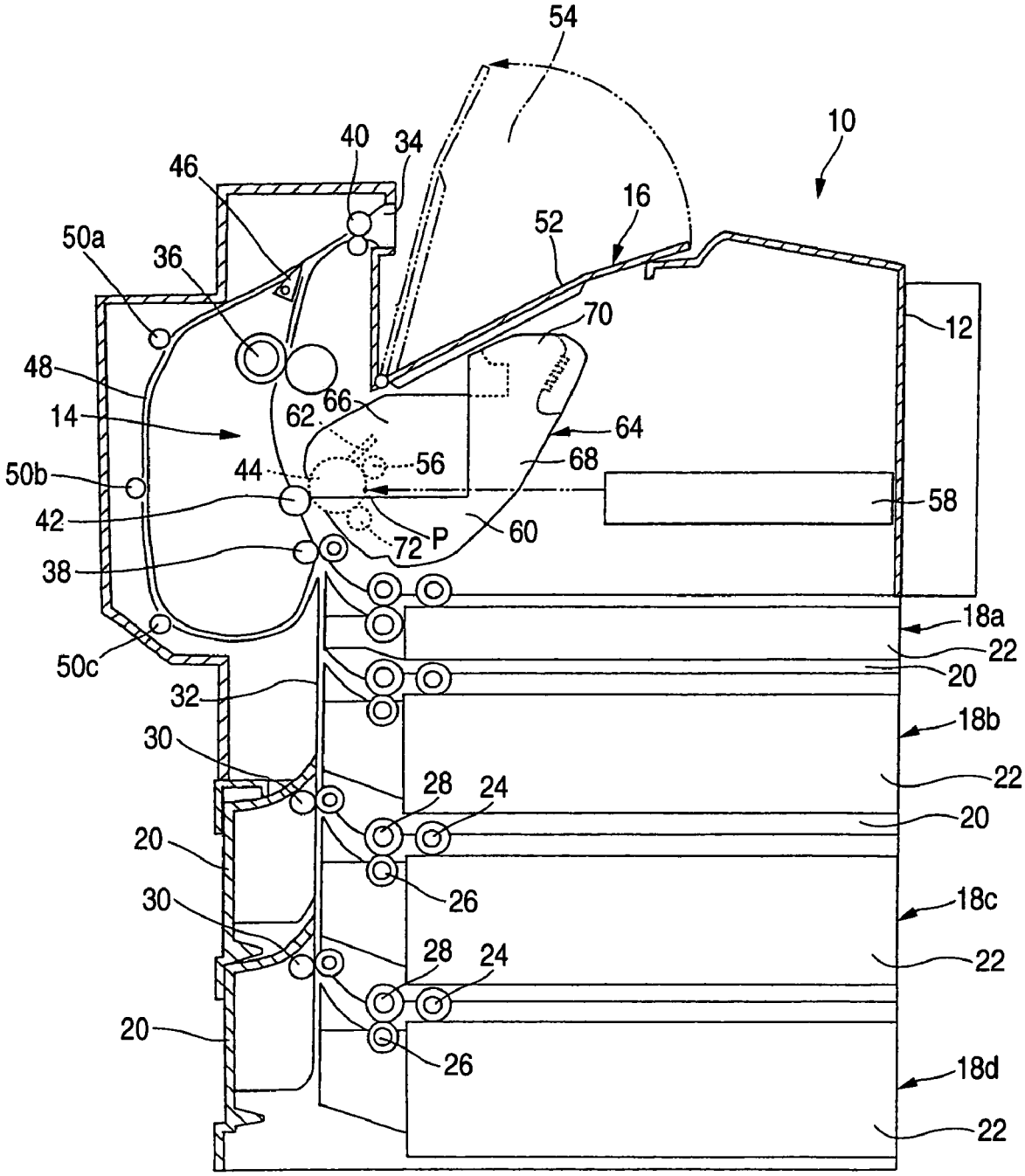
FIG. 1 is a cross sectional view showing an image forming apparatus according to a first embodiment of the invention.

Preferred embodiments of the present invention will be described with reference to the accompanying drawings. FIG. 1 shows a schematic view of an image forming apparatus 10 according to a first embodiment of the invention. The image forming apparatus 10 includes a main body 12 of the image forming apparatus (referred to as a apparatus body). An image forming unit 14 is provided in the image forming apparatus body 12. A sheet discharging portion 16 described later is disposed in an upper part of the image forming apparatus body 12. Two stages of paper feed units 18*a* and 18*b*, for example, are disposed in a lower part of the image forming apparatus body 12. Additionally, two stages of paper feed units 18*c* and 18*d*, which are attached and detached as an option unit, are disposed in the lower part of the image forming apparatus body 12.

The paper feed units 18*a* to 18*d* each includes a paper feed unit body 20 and a paper feed cassette 22 containing sheets. The paper feed cassette 22 is slidably attached to the paper feed unit body 20 and drawn out in a front side direction (to the right in FIG. 1). A paper feeding roll 24 is disposed on an upper part of the paper feed cassette 22 at a position near the inner-most part of the paper feed cassette 22. A retard roll 26 and a nadger roll 28 are located forward than the paper feeding roll 24. A pair of feeding rolls 30 are disposed in each of the optional paper feed units 18*c* and 18*d*. The image forming apparatus body 12 or the paper feed unit 18*c* located above supports the paper feeding roll 24 and the retard roll 26. The paper feed cassette 22 supports the retard roll 26.

The main transporting path 32 is a sheet path extending from the feeding roll 30 of the lowermost paper feed unit 18*d* to a sheet discharge port 34. The main transporting path 32 is located near a rear surface (left surface in FIG. 1) of the image forming apparatus body 12 and includes a substantially vertical part extending from the feeding roll 30 of the lowermost paper feed unit 18*d* to a fixing device 36 described later. A transfer device 42 and an image carrying body 44 are disposed upstream of the fixing device 36 of the main transporting path 32. A register roll 38 is disposed upstream of the transfer device 42 and the image carrying body 44. Further, a sheet discharging roll 40 is disposed near the sheet discharge port 34 of the main transporting path 32.

Accordingly, the retard roll 26 and the nadger roll 28 lead to the main transporting path 32 a recording medium, which is fed by the paper feed roll 24 from the paper feed cassette 22 of each of the paper feed units 18*a* to 18*d*. The register roll 38 temporarily stops the recording medium. The recording medium passes, at a given timing, through a position between a transfer device 42 and an image carrying body 44, which are described later so that a developer image is transferred thereon. The fixing device 36 fuses and fixes the developer image transferred onto the recording medium. The sheet discharging roll 40 discharges the recording medium through the sheet discharge port 34 to the sheet discharging portion 16.

In the case of both-side printing, the recording medium is returned to a reverse transporting path. That is, the main transporting path 32 branches off at before the sheet discharging roll 40. A first selector 46 is disposed at the branched part. The reverse transporting path 48 extends from the branched part to the register roll 38. Transporting rolls 50*a* to 50*c* are disposed on the reverse transporting path 48. In the case of the both-side printing, the first selector 46 is switched to a side to open the reverse transporting path 48. The sheet discharging roll 40 reversely rotates at a time point before a rear end of the recording medium reaches the sheet discharging roll 40 so that the recording medium is led to the reverse transporting path 48. The recording medium passes the register roll 38, the position between the transfer device 42 and the image carrying body 44, and the fixing device 36 and is discharged into the sheet discharging portion 16 from the sheet discharge port 34.

The sheet discharging portion 16 includes an inclined part 52, which is freely rotatable with respect to the image forming apparatus body 12. The inclined part 52 is inclined so that height thereof gradually increases from a part near the sheet discharge port 34 toward the front direction (to the right in FIG. 1). In other words, the part of the inclined part near sheet discharge port 34 is the lower end thereof, and the highest part thereof is the upper end thereof. The image forming apparatus body 12 supports the inclined part 52 so that it the inclined part 52 is rotatable, about the lower end thereof. When the inclined part 52 is rotated upward to open as indicated by a two-dot chain line in FIG. 1, an opened region 54 is formed. User attaches/detaches a process cartridge 64 described later through the opened region 54.

The image forming unit 14 includes an image carrying body 44, a charging device 56, an optical writing unit 58, a developing device 60, a transfer device 42, a cleaning unit 62, and a fixing device 36. The image carrying body 44 formed of a photo receptor for an electrophotography type, for example. The charging device 56 includes, for example, a charging roll for uniformly charging the image carrying body 44. The optical writing unit 58 optically writes a latent image onto the image carrying body 44 charged by the charging device 56. The developing device 60 visualizes the latent image on the image carrying body 44 formed by the optical writing unit 58 which is formed by the optical writing unit 58, by developer. The transfer device 42 includes, for example, a transfer roll for transferring the developer image formed by the developing device 60 onto a sheet. The cleaning unit 62, for example, including a blade removes developer left on the image carrying body 44. The fixing device 36 including a pressing roll and a heating roll fuses and fixes the developer image, which is transferred onto the sheet, onto the sheet. The optical writing unit 58 is, for example, a scanning type laser exposure device and is disposed near the front of the image forming apparatus body 12 with being parallel to the paper feed units 18*a* to 18*d*. The optical writing unit 58 exposes the image carrying body 44 across the developing device 60. An exposing position of the image carrying body 44 is a latent image writing position P. Incidentally, the embodiment uses the scanning type laser exposure device as the optical writing unit 58. However, the LED device or a surface emitting laser device may be used.

The image carrying body 44, the charging device 56, the developing device 60, and the cleaning unit 62 are integrated to form the process cartridge 64. The process cartridge 64 is disposed near and right under the inclined part 52 of the sheet discharging portion 16. As described above, the process cartridge 64 is attached/detached trough the opened region 54, which is defined when the inclined part 52 opens.

The process cartridge 64 is detachably divided into an image carrying unit 66 and a developing unit 68. The image carrying body 44, the charging device 56, and the cleaning unit 62 are disposed in the image carrying unit 66. The developing device 60 is disposed in the developing unit 68. The developing unit 68 includes a developer container 70 for containing developer and a developing roll 72 to which the developer is supplied from the developer container 70.

A manual paper feed unit 74 is fixed to the front part of the image forming apparatus body 12. As will be described later, the manual paper feed unit 74 supplies a recording medium from the manual paper feed unit 74 to the image forming unit 14 when a paper transporting unit is attached to the image forming apparatus body 12 instead of the uppermost paper feed cassette 22.

Figure 2:
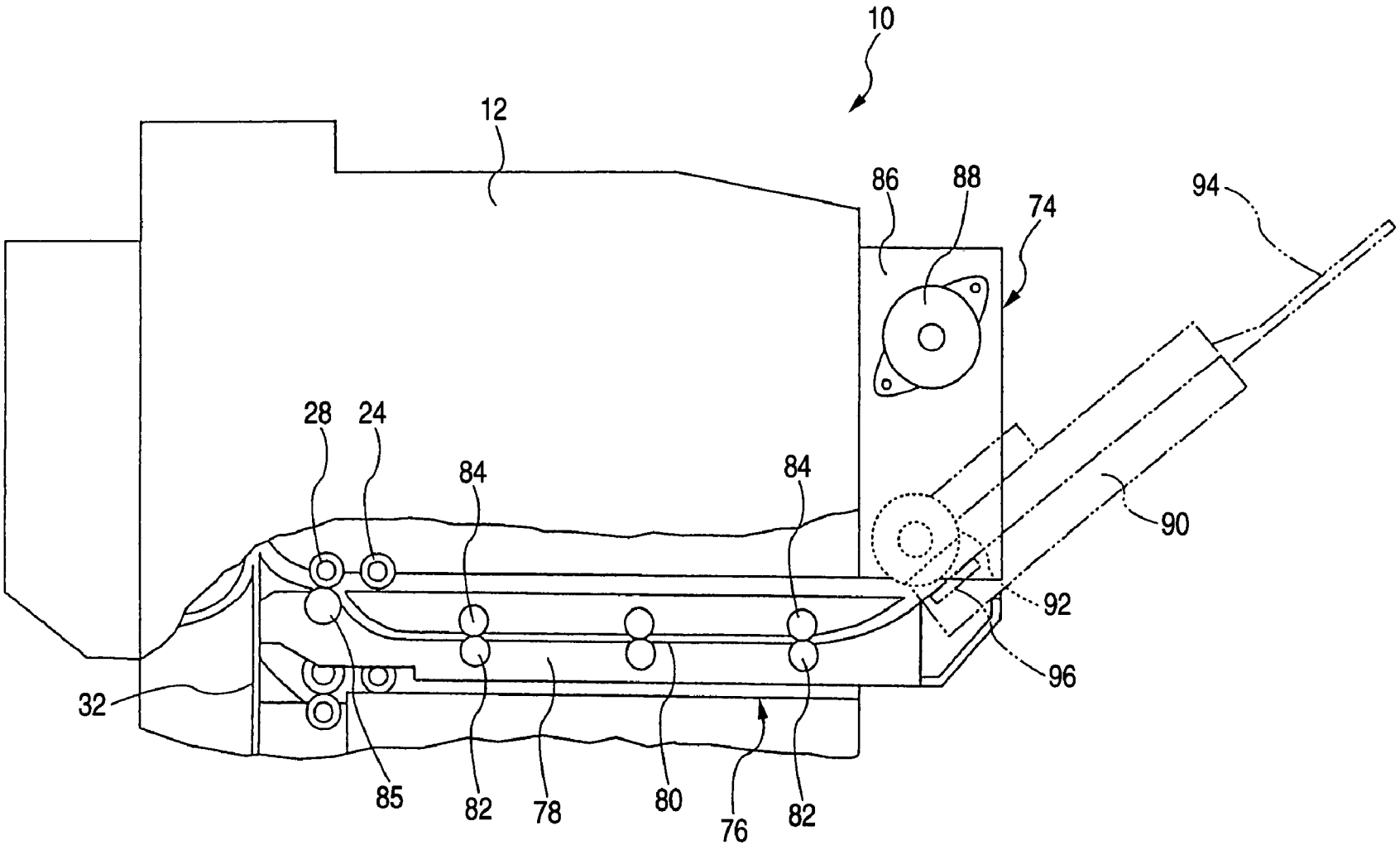
FIG. 2 is a side view, partly in section, showing a state of the image forming apparatus when a paper feed cassette is replaced with a paper transporting unit.
Figure 3:
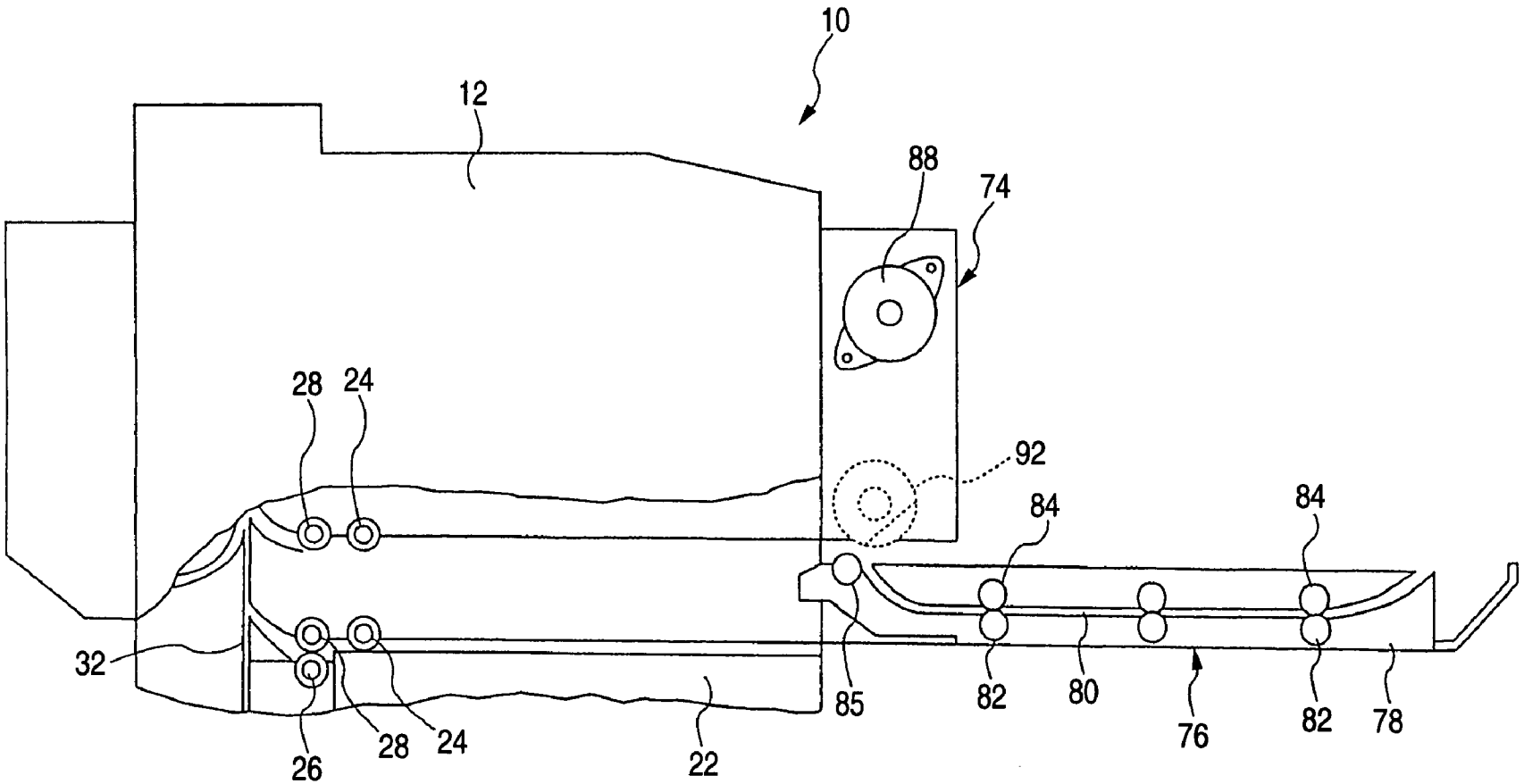
FIG. 3 is a side view, partly in section, showing a state of the image forming apparatus when a paper transporting unit is removed.

As shown in FIGS. 2 and 3, the paper transporting unit 76 is detachably attached to the paper feed unit 18*a* of the image forming apparatus body 12 in place of the paper feed cassette 22 of the paper feed unit 18*a* as described above. The paper transporting unit 76 includes a transfer-unit body 78, an in-unit transporting path 80, transporting rolls 82 (for example, three), auxiliary rolls 84, and a pinch roll 85. The in-unit transporting path 80 extends across an interior of the transfer-unit body 78. The transporting rolls 82 are disposed in the in-unit transporting path 80. The auxiliary rolls 84 are disposed to abut against the transferring rolls 82 with being opposite thereto. The pinch roll 85 is in contact with the nadger roll 28. When the paper transporting unit 76 is attached, the manual paper feed unit 74 is connected to the main transporting path 32 through the in-unit transporting path 80.

The manual paper feed unit 74 includes a manual paper feed unit body 86, a drive motor 88, a sheet stacking tray portion 90, and a feeding roll 92. The drive motor 88 is disposed on the manual paper feed unit body 86 as a drive source. The sheet stacking tray portion 90 in which sheets are stacked is disposed on the manual paper feed unit body 86. The feeding roll 92 feeds the sheets stacked on the sheet stacking tray portion 90. The sheet stacking tray portion 90 is supported on the manual paper feed unit body 86 so as to be rotatable about the feeding roll 92. An expandable sheet support portion 94 is provided on the sheet stacking tray portion 90. The sheet stacking tray portion 90 can be put in the manual paper feed unit body 86 in a manner that the sheet support portion 94 is inserted to the innermost end and the sheet stacking tray portion 90 is turned to the image forming apparatus body 12. On the other hand, when the sheet stacking tray portion 90 is turned to the front side, an exit of the sheet stacking tray portion 90 coincides with an entrance of the transfer-unit body 78. The feeding roll 92 is cut out in a semicircular shape, for example, and is opposed to a separation member 96 provided on the sheet stacking tray portion 90. The feeding roll 92 pinches and feeds recording media stacked on the sheet stacking tray portion 90 sheet one by one to the transfer-unit body 78.

The drive motor 88 is coupled to the feeding roll 92 via a gear train (not shown) to drive the feeding roll 92. Furthermore, the feeding roll 92 is coupled to the transporting rolls 82 of the paper transporting unit 76 via a gear train (not shown) and the transporting rolls 82 are driven by the drive motor 88. Incidentally, the transporting rolls 82 of the paper transporting unit 76 may be coupled to a drive motor of the image forming apparatus body 12 so that the transporting rolls 82 are driven from the image forming apparatus body side.

Accordingly, the manual paper feed unit 74 is detachably attached to the image forming apparatus body 12. Therefore, when paper jamming occurs in the manual paper feed unit 74, user easily removes the paper jamming by pulling the manual paper feed unit 74 from the image forming apparatus body 12 as shown in FIG. 3.

Next, operation of the first embodiment thus constructed will be described. The image carrying body 44 is uniformly charged by the charging device 56. The optical writing unit 58 emits light based on a image signal to irradiate the light onto the image carrying body 44 charged by the charging device 56. Therefore, a latent image is formed at the latent image writing position P. The light emitted from the optical writing unit 58 passes through inside of the process cartridge 64. The latent image, which is formed on the image carrying body 44 by the optical writing unit 58, is visualized by the developer in the developing device 60.

As shown in FIG. 1, when the paper feed cassettes 22 are attached to the paper feed units 18*a* to 18*d*, respectively, one of the paper feed units 18*a* to 18*d* is selected according to a size signal or the like. A recording medium contained in the one of the paper feed cassettes 22 is fed by the paper feeding roll 24. The recording medium is handled by the retard roll 26 and the nadger roll 28. The register roll 38 is temporarily stops the recording medium. The recording medium is led to the position between the transfer device 42 and the image carrying body 44 at a proper timing.

In this way, when the recording medium is led to the position between the transfer device 42 and the image carrying body 44, the developer image is transferred from the image carrying body 44 onto the recording medium by the transfer device 42. The recording medium, on which the developer is transferred, is ejected to the sheet discharging portion 16 through the fixing device 36 and the sheet discharge port 34.

When manual paper feed is required, the paper feed cassette 22 is drawn out of the paper feed unit 18*a* and the paper transporting unit 76 is attached to the image forming apparatus body 12 instead. Then, the sheet stacking tray portion 90 for the manual paper feed unit 74 is rotated frontward and recording media are stacked in the sheet stacking tray portion 90. Incidentally, the recording media may be stacked in the sheet stacking tray portion 90 in advance. Next, when the feeding roll 92 is rotated, the feeding roll 92 cooperates with the sheet support portion 94 to handle the recording media and feeds the recording medium sheet one by one to the paper transporting unit 76. The recording medium fed to the paper transporting unit 76 is fed to the main transporting path 32 by the transporting rolls 82 of the paper transporting unit 76. Then, an image is formed on the recording medium by the image forming unit 14.

(Second Embodiment)

Figure 4:
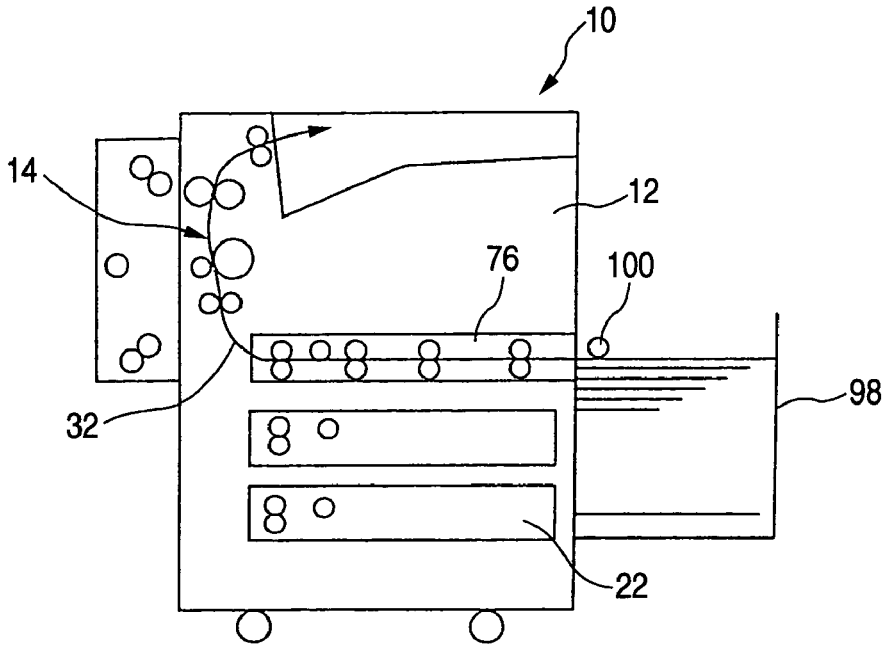
FIG. 4 is a side view showing an image forming apparatus according to a second embodiment of the invention.

FIG. 4 shows a second embodiment of the invention. In the second embodiment, a paper transporting unit 76 is attached to the image forming apparatus body in place of the paper feed cassette 22 and a large capacity tray 98 is coupled to the paper transporting unit 76. The large capacity tray 98 is detachably fixed to the front part of the image forming apparatus body 12. The large capacity tray 98 feeds recording media to the paper transporting unit 76 by using a supply role 100. Accordingly, the recording media stacked in the sheet support portion 94 are fed one by one to the main transporting path 32 through the paper transporting unit 76. Then, an image is formed on the recording medium by the image forming unit 14.

(Third Embodiment)

Figure 5:
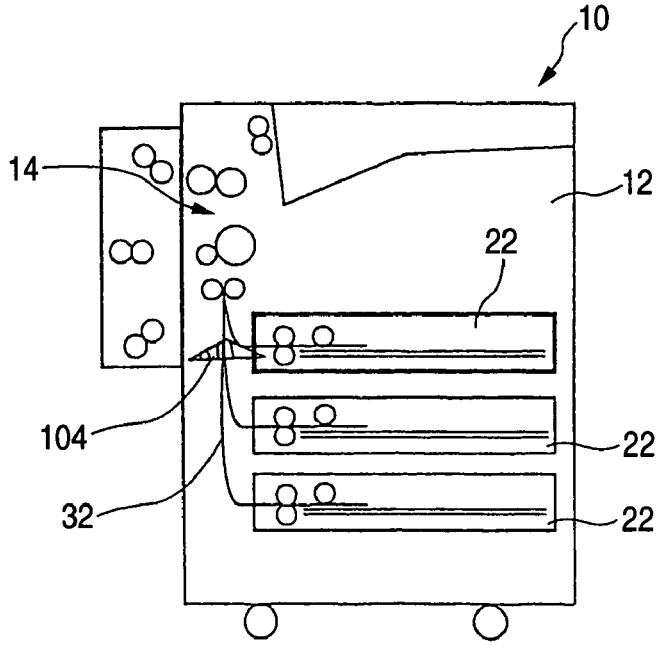
FIG. 5 is a side view showing an image forming apparatus according to a third embodiment of the invention when paper feed cassettes are loaded into the image forming apparatus body and recording media are fed from the paper feed cassettes.
Figure 6:
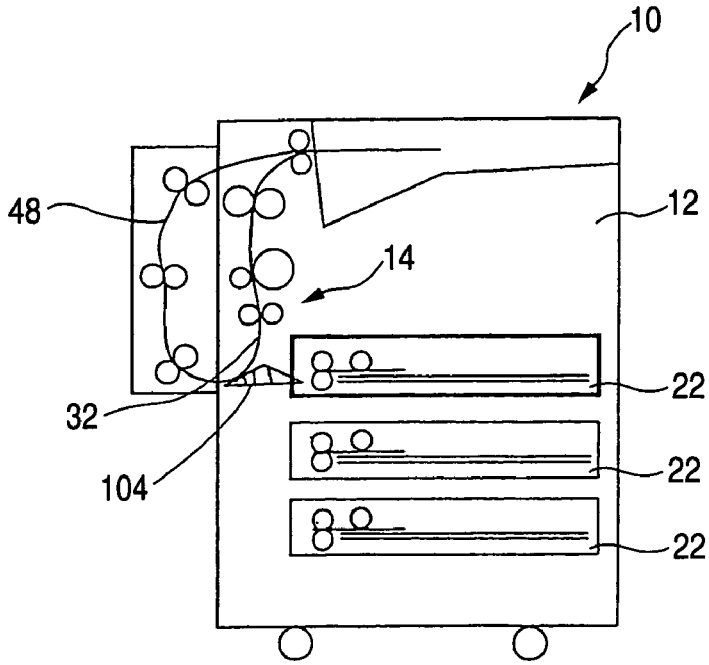
FIG. 6 is a side view showing a state of the image forming apparatus according to the third embodiment in which paper feed cassettes are loaded into the image forming apparatus body and a recording medium is fed from a reverse transporting path.
Figure 7:
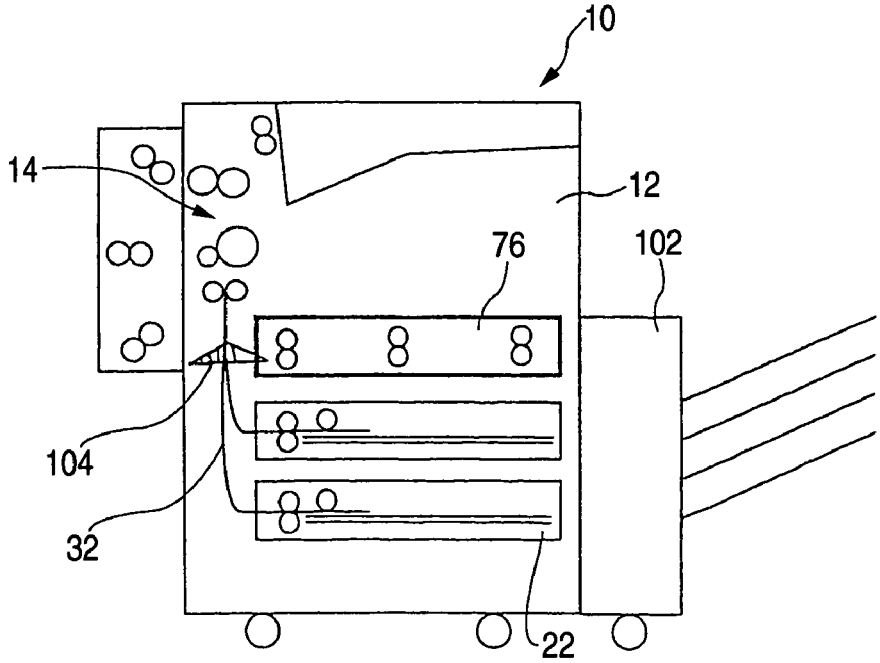
FIG. 7 is a side view showing the state of the image forming apparatus according to the third embodiment in which the paper transporting unit is loaded into the image forming apparatus body and recording media are fed from the paper feed cassettes.
Figure 8:
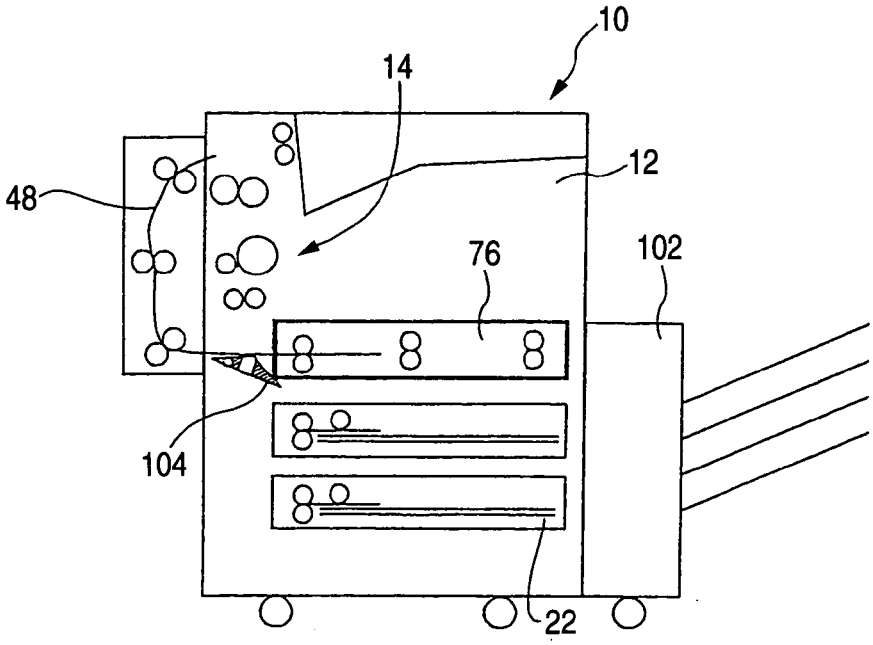
FIG. 8 is a side view showing the state of the image forming apparatus according to the third embodiment in which the paper transporting unit is loaded into the image forming apparatus body and recording media are fed from the reverse transporting path.

A third embodiment of the invention is shown in FIGS. 5 to 8. In the third embodiment, the paper feed cassette 22 is replaceable with the paper transporting unit 76. When the paper transporting unit 76 is attached to the image forming apparatus body in place of the paper feed cassette 22, a postprocessor 102 is coupled to the paper transporting unit 76. FIGS. 5 and 6 are a case where the paper feed cassette 22 is attached to the image forming apparatus body. FIGS. 7 and 8 show a case where the paper transporting unit 76 and the postprocessor 102 are attached to the image forming apparatus body. A second selector 104 is disposed at an exit part of the reverse transporting path 48. The second selector 104 is switched between a first position and a second position. The first position allows the recording medium to pass through the main transporting path 32 and leads the recording medium coming from the reverse transporting path to return to the main transporting path 32. The second position leads the recording medium coming from the reverse transporting path 48 to the paper transporting unit 76 with moving across the main transporting path 32. That is, when the paper feed cassette 22 is attached to the image forming apparatus body, the second selector 104 is present 104 is at the first position so that the one-side and both-side printing are allowed, as shown in FIGS. 5 and 6. On the other hand, when the paper transporting unit 76 and the postprocessor 102 are attached to the image forming apparatus body and the one-side and/or both-side printing are carried out, the second selector 104 is at the first position as shown in FIG. 7. However, when the post-process is performed, the second selector is switched to the second position as shown in FIG. 8 and the recording medium (recording medium of which one or both sides are printed) coming from the reverse transporting path 48 is led to the paper transporting unit 76. Then, the recording medium passes through the paper transporting unit 76 and is led to the postprocessor 102 so that the postprocessor 102 carries out the post-process on the recording medium.

Incidentally, the postprocessor 102 involves a sorter, stapler, puncher, or the like.

(Fourth Embodiment)

Figure 9:
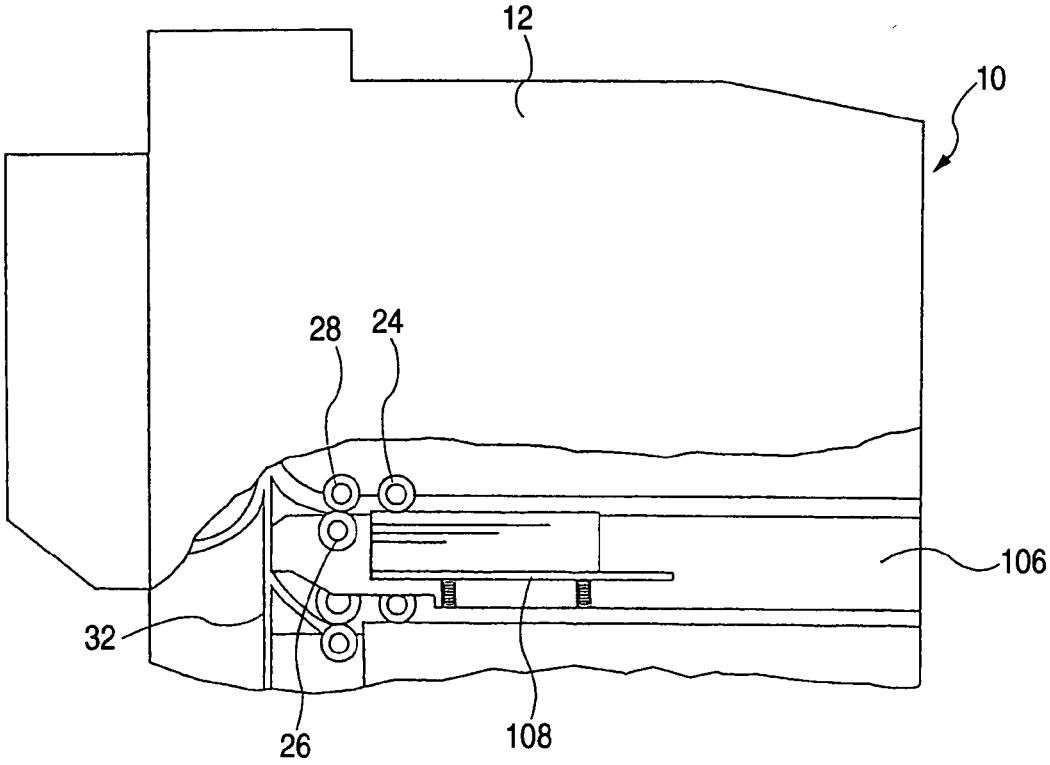
FIG. 9 is a side view, partly in section, showing an image forming apparatus according to a fourth embodiment of the invention.

FIG. 9 shows a fourth embodiment of the invention. In the fourth embodiment, the paper feed cassette 22 is replaceable with a particular paper feed unit 106. The particular paper feed unit 106 is, for example, an envelope feeder. The particular paper feed unit 106 includes a tray 108 in which envelopes are stacked, and a retard roll 26. The envelopes stacked in the tray 108 are fed one by one by the paper feeding roll 24, handled by the retard roll 26 and nadger roll 28, and led to the main transporting path 32.

(Fifth Embodiment)

Figure 10:
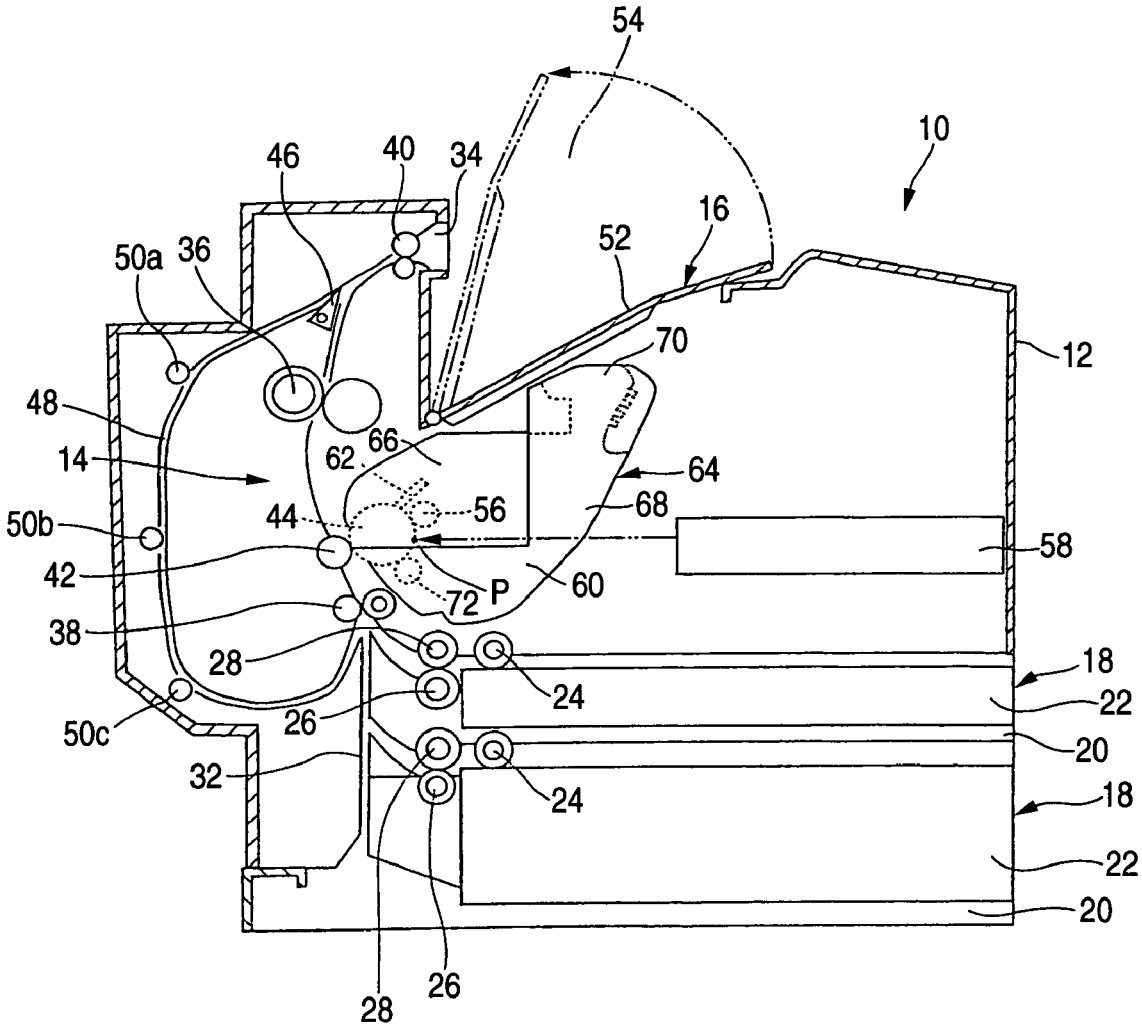
FIG. 10 is a cross sectional view showing an image forming apparatus according to a fifth embodiment of the invention.

Next, a fifth embodiment of the invention will be described with reference to FIGS. 10 through 22. FIG. 10 shows a scheme of an image forming apparatus 10 according to a fifth embodiment of the invention. The same reference numerals are allotted to the same portions as in the first to fourth embodiments.

Figure 11:
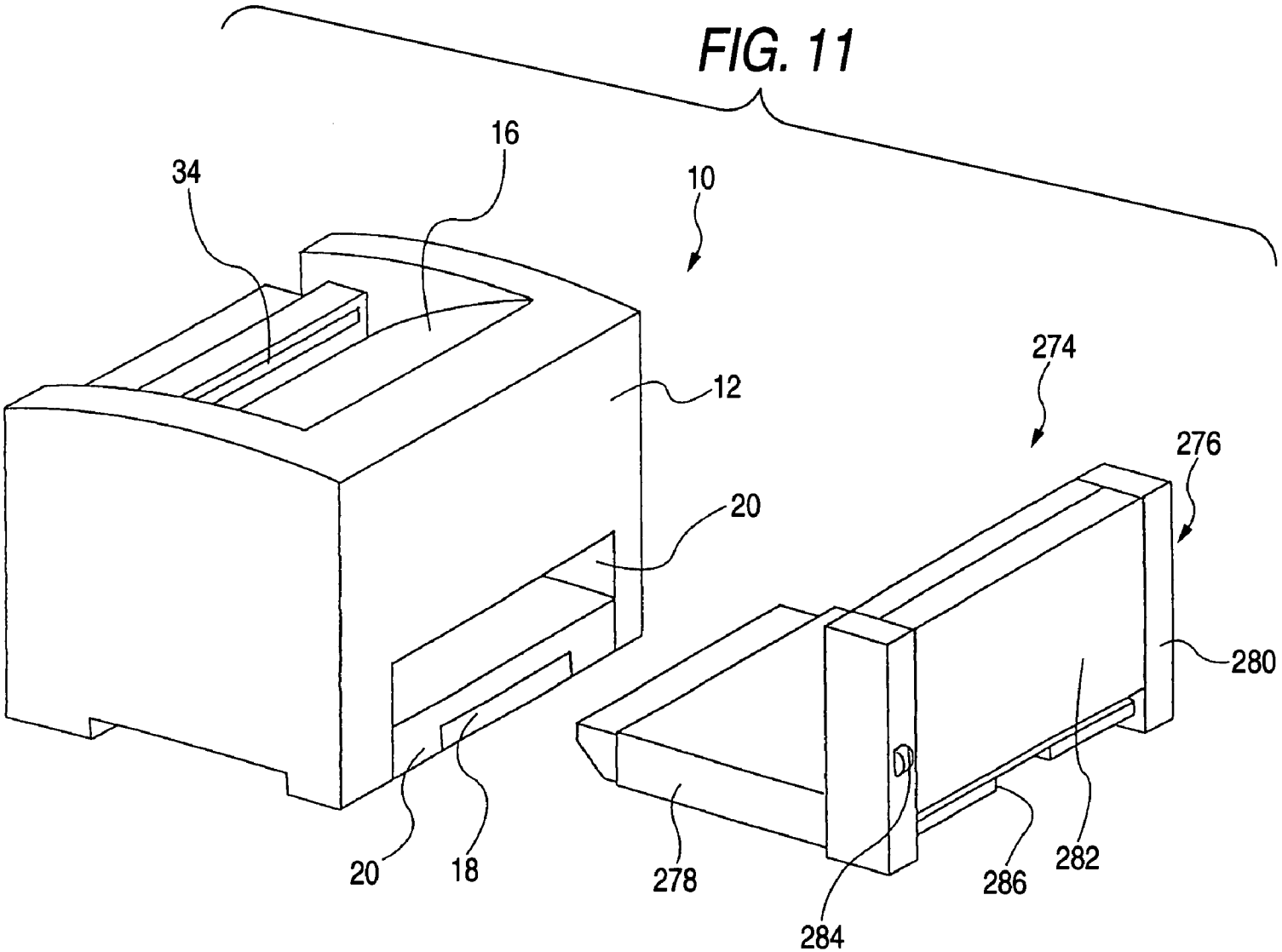
FIG. 11 is a perspective view showing the image forming apparatus before a manual paper feed unit is attached to the image forming apparatus body.
Figure 12:
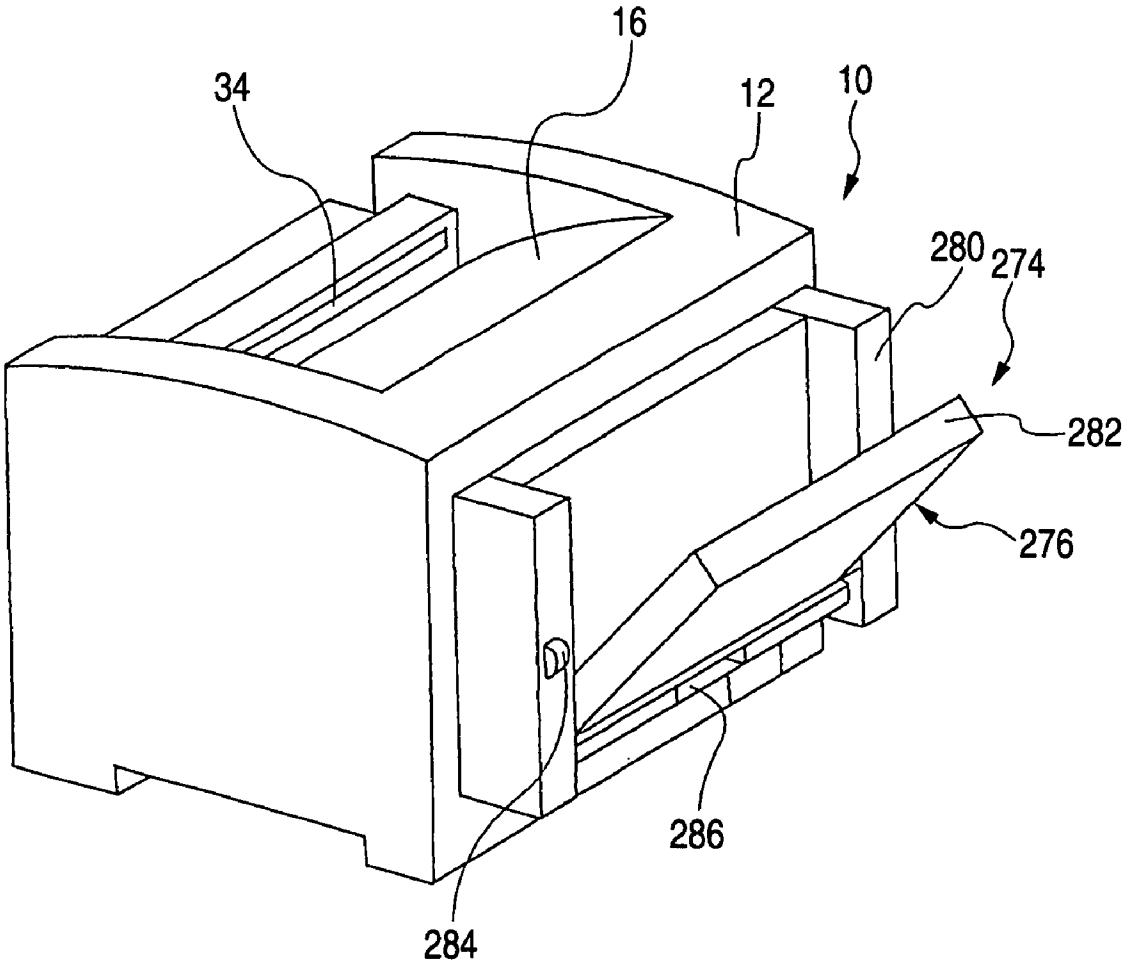
FIG. 12 is a perspective view showing the image forming apparatus after the manual paper feed unit is attached to the image forming apparatus body.
Figure 18:
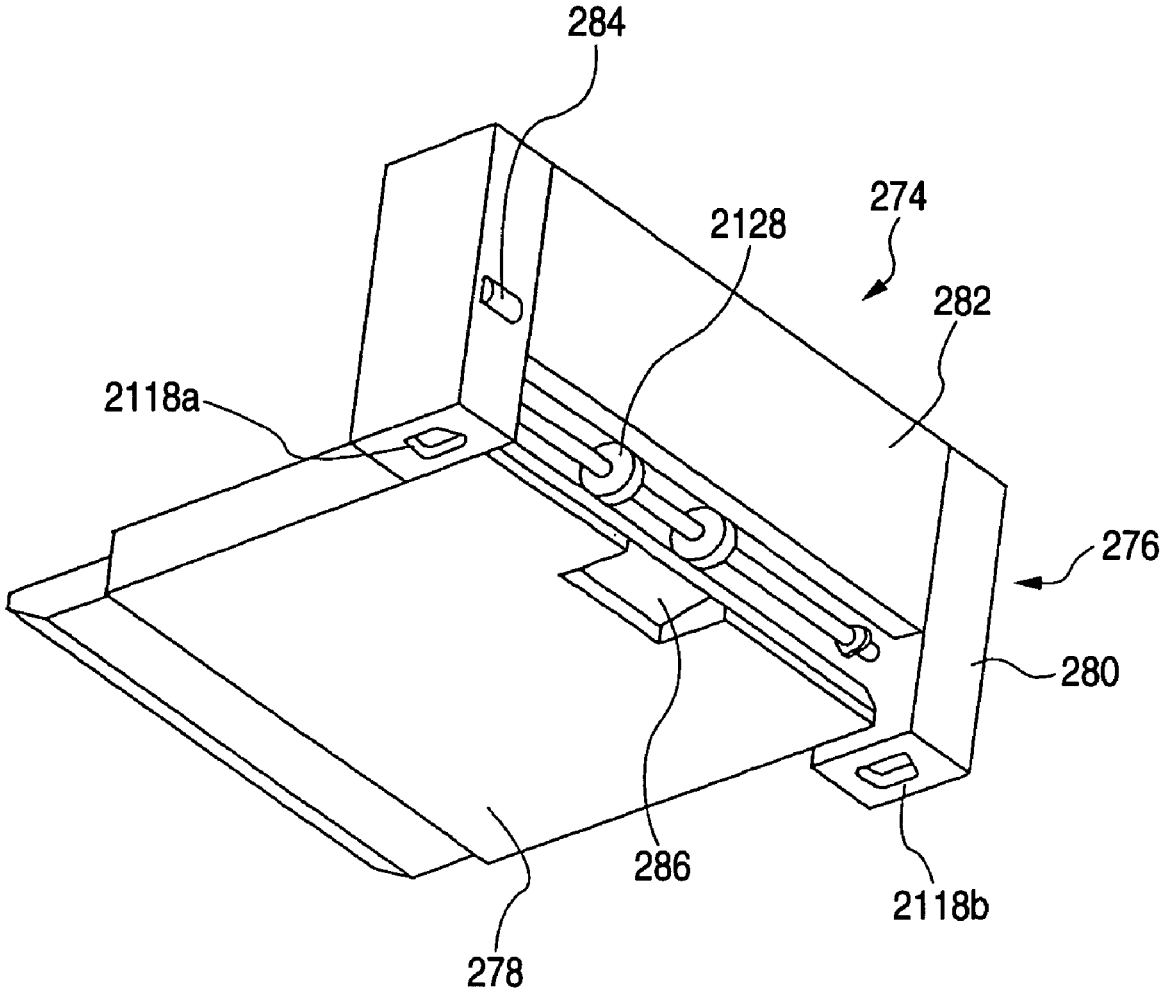
FIG. 18 is a perspective view showing a manual paper feed unit according to the fifth embodiment of the invention with being viewed from a rear side.

In FIGS. 11 and 12, the paper feed unit 18 can receive a manual paper feed unit 274 in place of the paper feed cassette 22. The manual paper feed unit 274 includes a main body portion 276 and a transporting portion 278. The main body portion 276 is provided on the front part of the image forming apparatus body 12. The transporting portion 278 protrudes from the main body portion 276 to the image forming apparatus body 12. The main body portion 276 includes a tray containing portion 280 and a paper feed tray 282. The tray containing portion is fixed to the image forming apparatus body 12. The paper feed tray 282 is rotatably supported by the tray containing portion 280. A dial portion 284 for setting a size of a sheet to be stored in the paper feed tray 282 is provided on the front of the tray containing portion 280. The manual paper feed unit 274 includes a locking member for preventing the transporting portion 278 from being drawn out till the main body portion 276 is attached to the image forming apparatus body 12. In addition, as shown in FIG. 18, for example, a lower part of the front of the transporting portion 278 includes a handle portion 286 for integrally attaching the main body portion 276 and the transporting portion 278 to the image forming apparatus body 12. The user attaches/detaches the manual paper feed unit 274 to/from the image forming apparatus body 12 by putting his/her hand on and holding the handle portion 286.

Figure 13:
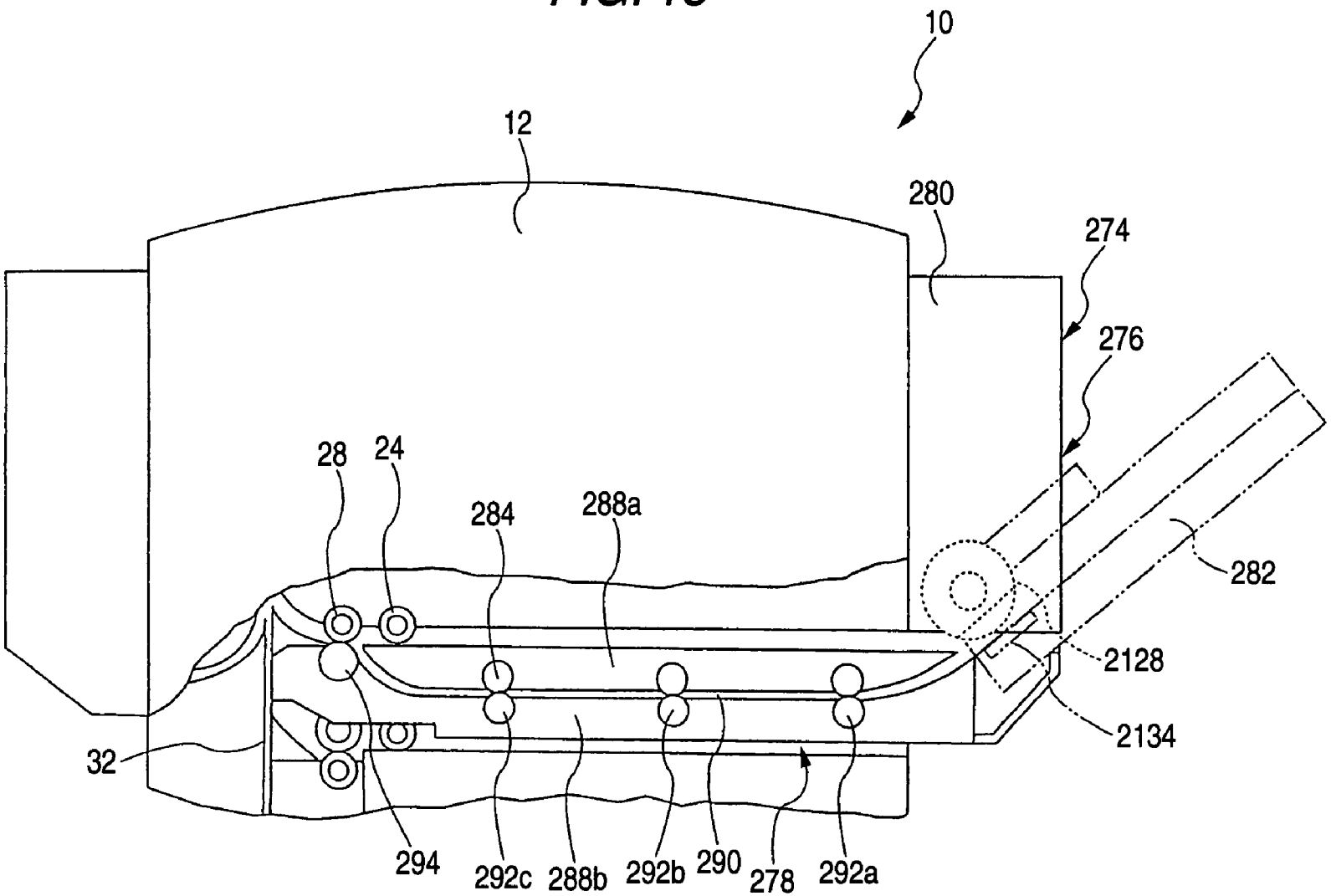
FIG. 13 is a perspective view showing the image forming apparatus when the manual paper feed unit is attached to the image forming apparatus body.
Figure 14:
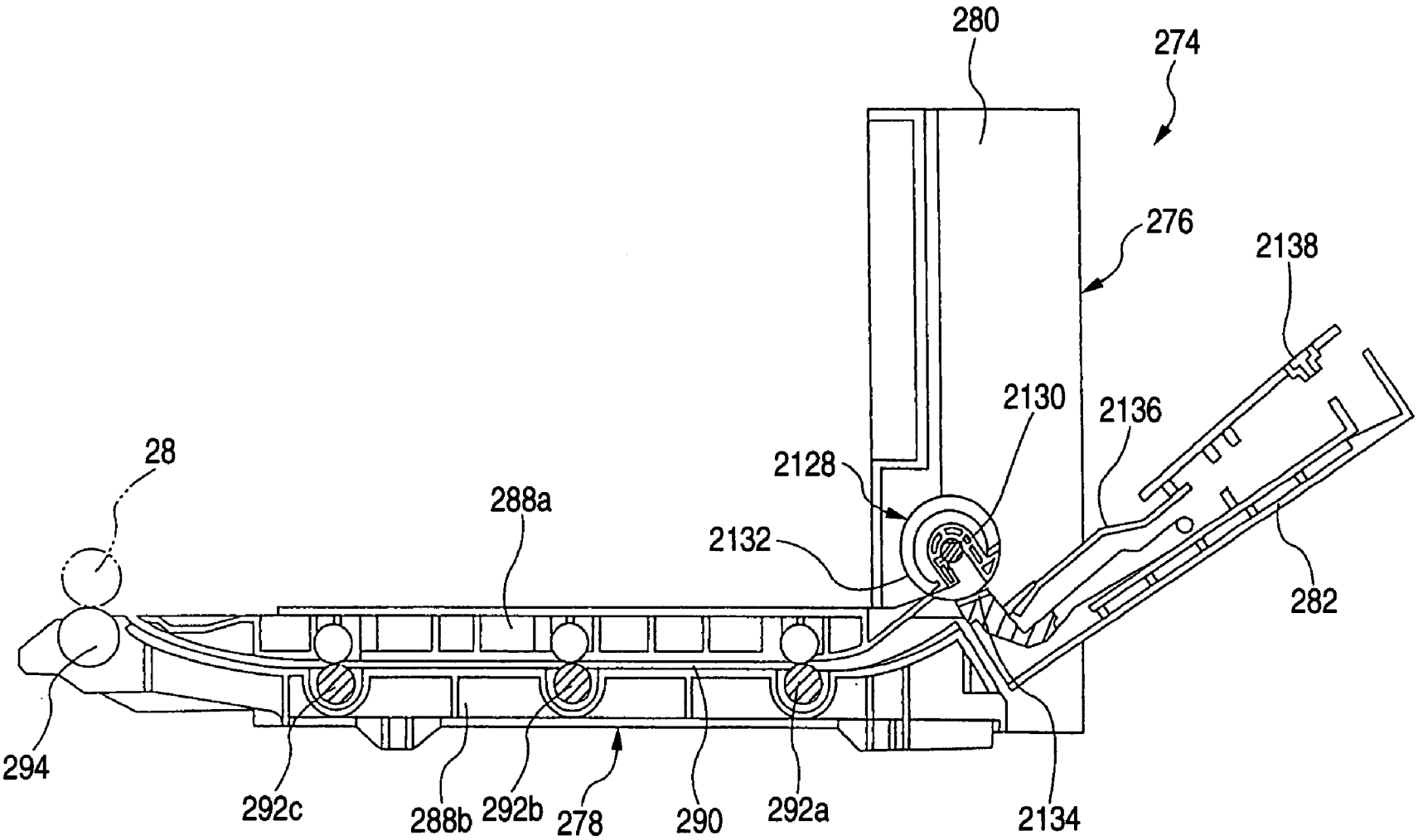
FIG. 14 is a cross sectional view showing a manual paper feed unit according to the fifth embodiment of the invention.

FIGS. 13 and 14 show the manual paper feed unit 274 in detail. The transporting portion 278 of the manual paper feed unit 274 includes two guide portions, that is, upper and lower guide portions 288*a* and 288*b*. A transporting path 290 for manual paper feed is formed between the upper and lower guide portions 288*a* and 288*b*. Also, three pairs of transporting rolls 292*a* to 292*c* are provided between the upper and lower guide portions 288*a* and 288*b*. In this embodiment, the rolls of the three pairs of transporting rolls 292*a* to 292*c*, which are supported on the upper guide portion 288*a*, are auxiliary rolls and the rolls of the three pairs of transporting rolls 292*a* to 292*c*, which are supported by the lower guide portion 288*b*, are drive rolls. A pinch roll 294 is rotatably supported at a position near a tip end of the transporting portion 278. The pinch roll 294 is brought into contact with the nadger roll 28, and rotated with the rotation of the nadger roll 28.

Figure 15A:
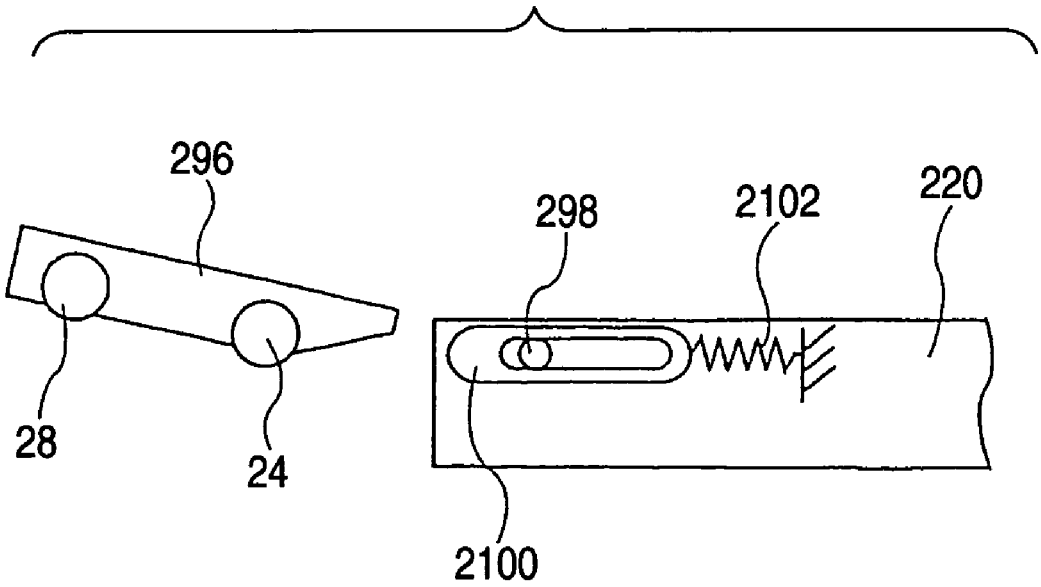
FIG. 15 is a diagram showing a structure state before (FIG. 15A) and after (FIG. 15B) the manual paper feed unit is inserted
Figure 15B:
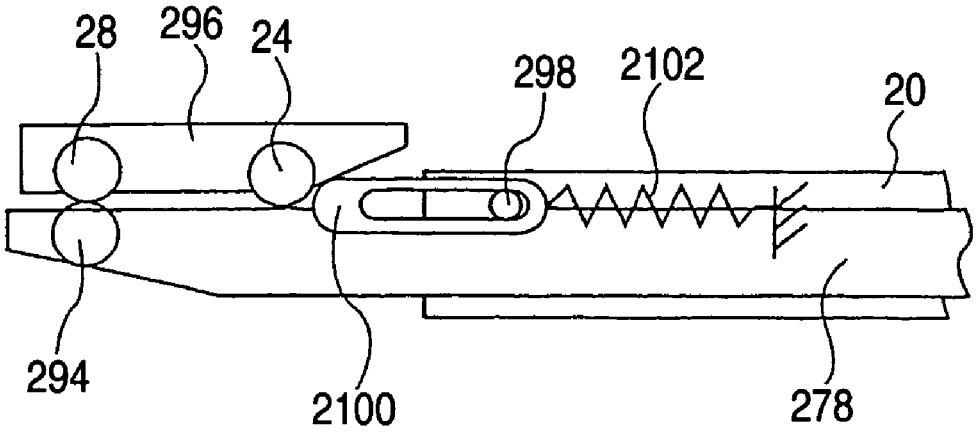

As shown in FIG. 15, the paper feeding roll 24 is movably supported by a roll support member 296 with the nadger roll 28 of the image forming apparatus body side serving as a fulcrum. A pin 298 is formed to protrude from a side surface of the paper feed unit body 20. A movable member 2100 is slidably fitted to the pin 298. The movable member 2100 is urged by a first elastic member 2102 in a direction opposite to an insertion direction of the manual paper feed unit 274. When the transporting portion 278 of the manual paper feed unit 274 is inserted under the state shown in FIG. 15A, the transporting portion 278 comes in contact with the movable member 2100 to move the movable member 2100. As a result, as shown in FIG. 15B the movable member 2100 comes in contact with the roll support member 296 to raise the paper feeding roll 24. Accordingly, before the manual paper feed unit 274 is inserted, the paper feeding roll 24 is rotatable to make it easy to remove a jammed sheet. When the manual paper feed unit 274 is inserted, the roll support member 296 is fixed to stabilize the sheet transfer from the transporting portion 278.

Figure 16:
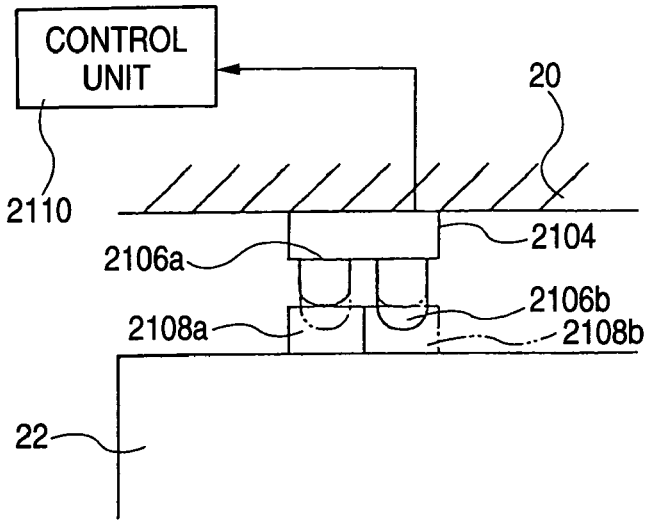
FIG. 16 is a diagram showing a structure including a first detecting member and vicinity thereof.

As shown in FIG. 16, the paper feed unit body 20 is provided with a first microswitch 2104 as a first detecting unit. The first microswitch 2104 includes, for example, two switch portions 2106*a* and 2106*b*. . A first protruded portion 2108*a* protruded from the paper feed cassette 22 comes contact with the first switch portion 2106*a* . When the manual paper feed unit 274 is attached to the image forming apparatus body 12, a second protruded portion 2108*b* protruded from the transporting portion 278 comes in contact with the second switch portion 2106*b*. The switch portions, when thus contact with the related protruded portions, outputs signals different from each other. In accordance with signals from the first microswitch 2104, a control unit 2110 contained in the image forming apparatus body side performs controls suitable for a case where the paper feed cassette 22 is inserted and a case where the manual paper feed unit 274 is inserted.

Figure 17A:
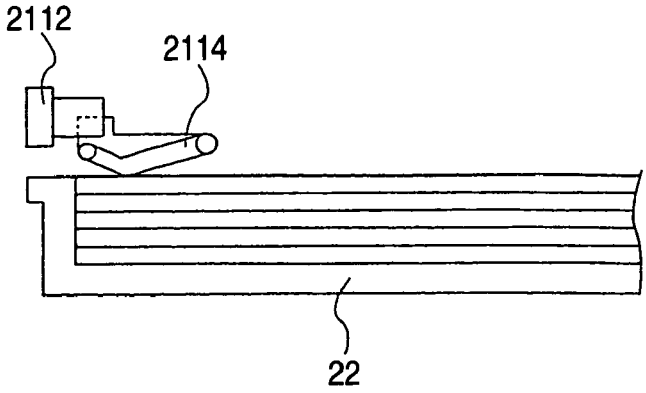
FIG. 17A is a cross sectional view showing the structure when the paper feed cassette is attached.
Figure 17B:
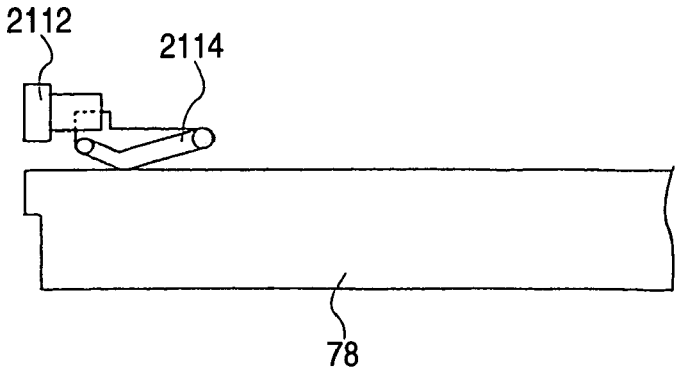
FIG. 17B is the structure when the manual paper feed unit is attached.

Further, as shown in FIG. 17, the paper feed unit body 20 includes a second microswitch 2112 as a second detecting unit. The second microswitch 2112 faces to an actuator 2114. When the paper feed cassette 22 is attached, the second microswitch 2112 detects presence or absence of sheet in the paper feed cassette 22 (FIG. 17A). When the manual paper feed unit 274 is attached, the second microswitch 2112 detects the presence or absence of the manual paper feed unit 274 (FIG. 17B). Thus, the second microswitch 2112 serves as a common detecting unit.

Figure 19:
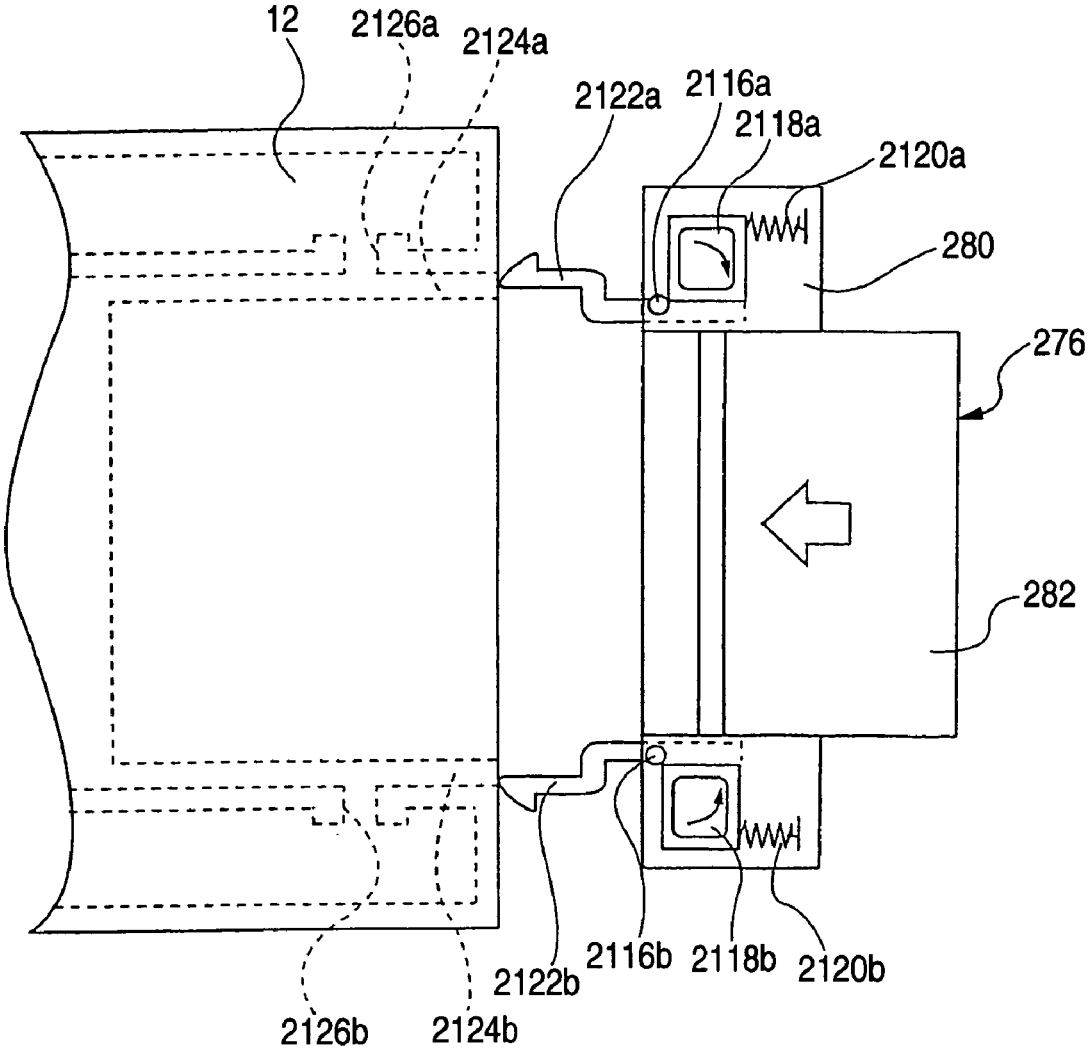
FIG. 19 is a rear view showing a structure state before the manual paper feed unit of the invention is fixed to the image forming apparatus body.

The main body portion 276 of the manual paper feed unit 274 includes a holding member and a holding removal member. The holding member makes the image forming apparatus body 12 detachably hold the main body portion 276. The holding removal member removes this holding by the holding member. The holding removal member is located at a position on the main body portion 276, which is not conspicuous to the user, for example, a bottom surface of the main body portion 276, as shown in FIG. 18. The holding member and the holding removal member are constructed as shown in FIG. 19. That is, latch bars 2118*a* and 2118*b*, which are rotatably supported on rotary shafts 2116*a* and 2116*b*, are provided on the bottom surface of the main body portion 276. Second elastic members 2120*a* and 2120*b* in an arrow direction shown in FIG. 19 urge the latch bars 2118*a* and 2118*b*, while latch portions 2122*a* and 2122*b* abut against the latch bars 2118*a* and 2118*b*, respectively. The latch portions 2122*a* and 2122*b* are protruded from the main body portion 276 to the image forming apparatus body 12. The latch portions 2122*a* and 2122*b* move to the right and left in response to the rotation of the latch bars 2118*a* and 2118*b*. Latch grooves 2124*a* and 2124*b* into which the latch portions 2122*a* and 2122*b* are inserted are provided in the image forming apparatus body 12. Latch engaging portions 2126*a* and 2126*b* are formed on the latch grooves 2124*a* and 2124*b*, respectively. When the latch portions 2122*a* and 2122*b* of the main body portion 276 are inserted into the latch grooves 2124*a* and 2124*b* of the image forming apparatus body 12, the latch portions 2122*a* and 2122*b* engage with the latch engaging portions 2126*a* and 2126*b*. Therefore, the main body portion 276 is held by the image forming apparatus body 12. When the latch bars 2118*a* and 2118*b* are turned with resisting the second elastic members 2120*a* and 2120*b* under this state, the latch bars 2118*a* and 2118*b* push and move the latch portions 2122*a* and 2122*b* to disengage the latch portions 2122*a* and 2122*b* from the latch engaging portions 2126*a* and 2126*b*. By pulling the main body portion 276 out, the main body portion 276 is removed from the image forming apparatus body 12.

A feed roll 2128 for manual paper feed includes a rotary shaft 2130 and a partially cut roll portion 2132. The feed roll 2128 is supported on the main body portion 276 with being rotatable about the rotary shaft 2130. The paper feed tray 282 includes a separation pad 2134 facing to the partially cut roll portion 2132. The sheet fed by the feed roll 2128 for manual paper feed is separated by the separation pad 2134.

The feed roll 2128 for manual paper feed is located at a position out of a drawing-out locus line of the transporting portion 278. The paper feed tray 282 is turned between a paper feed position at which the stacked sheets are fed and an avoidance position at which the paper feed tray 282 is out of the drawing-out locus line of the transporting portion 278. Accordingly, when the feed roll 2128 for manual paper feed is out of the drawing-out locus line of the transporting portion 278 and the paper feed tray 282 is at the avoidance position, the paper feed tray 282 is out of the drawing-out locus line of the transporting portion 278. Therefore, the transporting portion 278 may be drawn out of the paper feed unit body 20. When the paper feed tray 282 is at the paper feed position, the transporting portion 278 abut against the paper feed tray 282 to prohibit the transporting portion 278 from being drawn out.

Figure 20A:
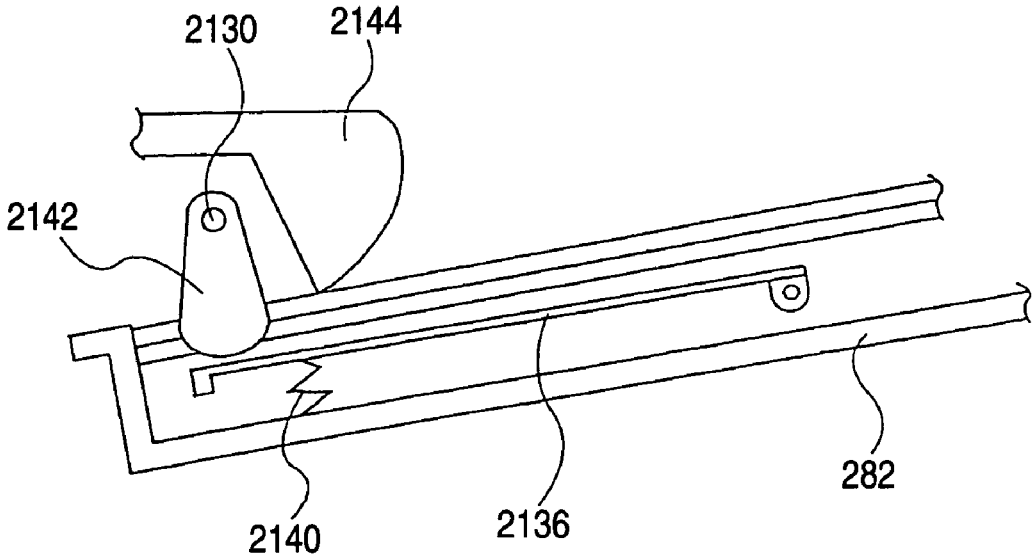
FIG. 20A is a cross sectional view showing the structure when the paper feed tray is at a paper feed position.
Figure 20B:
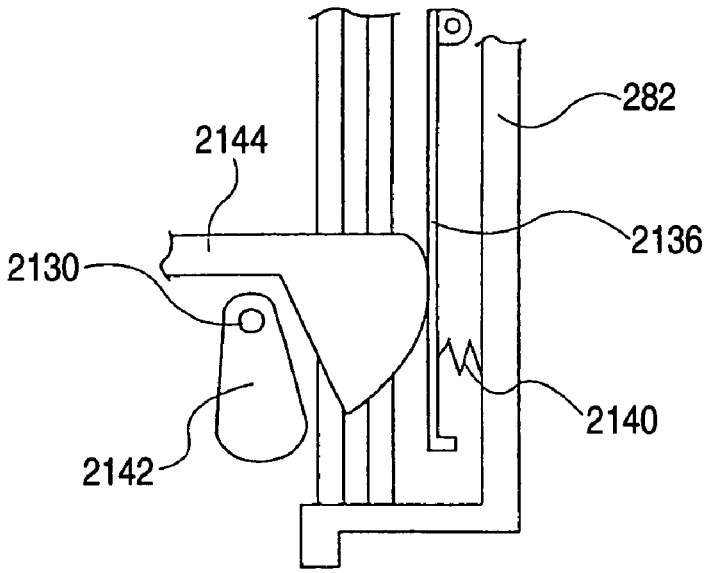
FIG. 20B is a cross sectional view showing the paper feed tray is at an avoidance position.

The paper feed tray 282 includes a bottom plate 2136 and a sheet table 2138 coupled to the bottom plate 2136. The bottom plate 2136, as shown in FIG. 20, urges and presses sheet located on the bottom plate 2136 against the partially cut roll portion 2132 of the feed roll 2128 for manual paper feed by a third elastic member 2140. A movable cam 2142 is provided on the rotary shaft 2130 of the feed roll 2128 for manual paper feed. A fixed cam 2144 is provided on the tray containing portion 280. When the paper feed tray 282 is at the paper feed position as shown in FIG. 20A, the movable cam 2142 presses the bottom plate 2134 against the third elastic member 2140 to separates the sheet from the feed roll 2128 for manual paper feed every time the sheet is fed by the feed roll 2128 for manual paper feed. When the paper feed tray 282 is at the avoidance position (housing position) as shown in FIG. 20B, the fixed cam 2144 presses the bottom plate 2136 against the third elastic member 2140 to hold down the bottom plate 2136. Accordingly, also when the paper feed tray 282 is raised and housed in the tray containing portion 280, the paper feed tray 282 prevents the sheet from raising to make it easy to house the paper feed tray 282.

Figure 21:
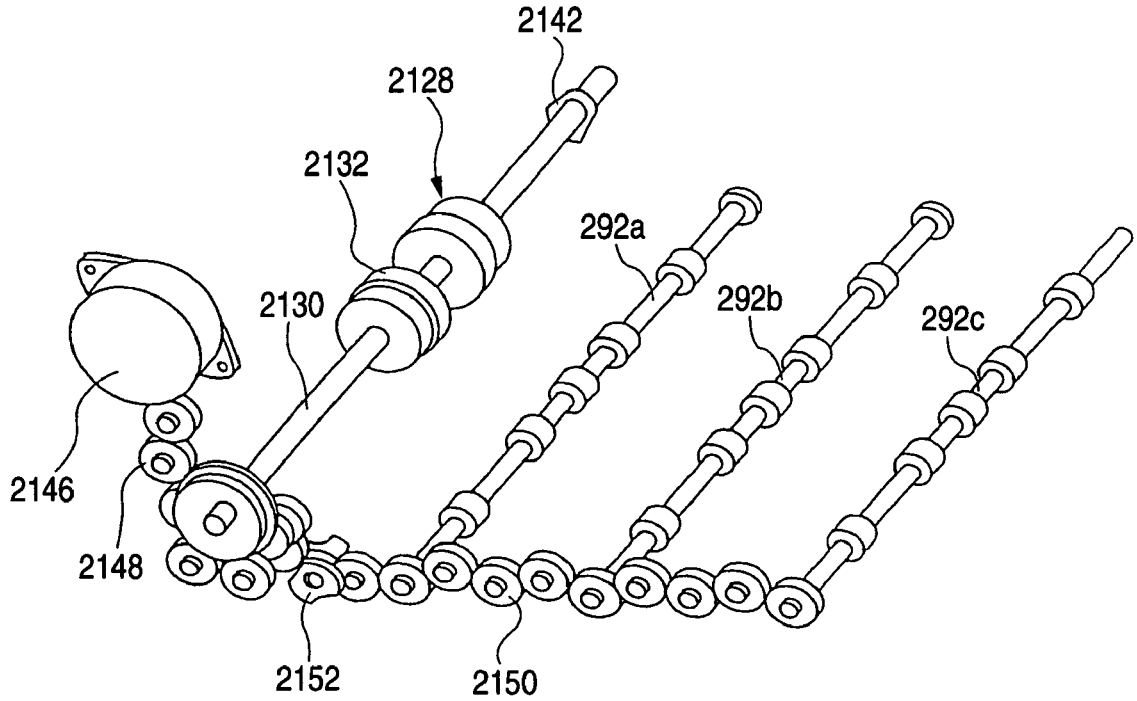
FIG. 21 is a perspective view showing a drive system for driving a manual inserter feed roll and transporting rolls according to the fifth embodiment of the invention.
Figure 22:
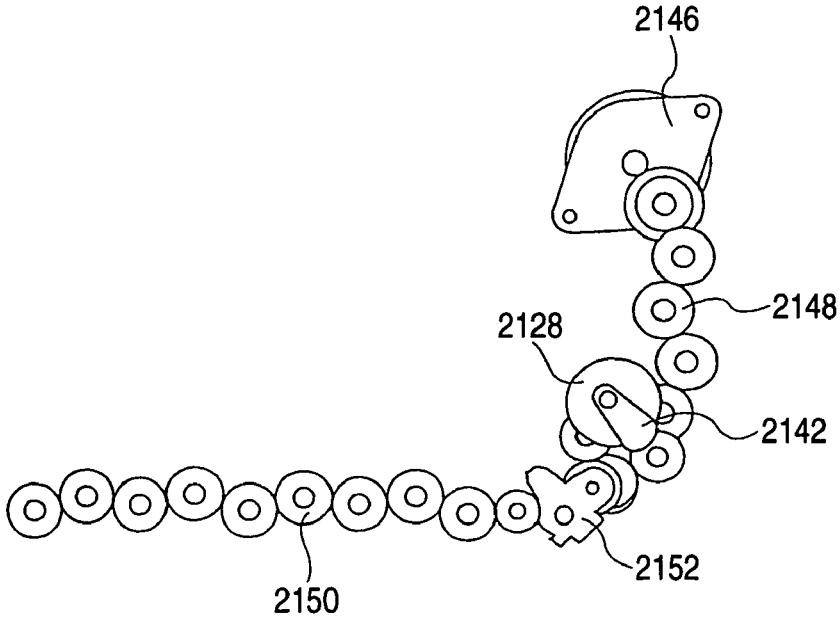
FIG. 22 is a side view showing the drive system for driving the manual inserter feed roll and transporting rolls according to the fifth embodiment of the invention.

FIGS. 21 and 22 show a drive system for driving the transporting rolls 292*a* to 292*c* and the feed roll 2128 for manual paper feed. A drive motor 2146 as a drive source is provided in the tray containing portion 280 of the main body portion 276. The drive motor 2146 and the feed roll 2128 for manual paper feed are coupled to each other by means of a first gear train 2148, which is a first drive force transmitting member. The feed roll 2128 for manual paper feed and the transporting rolls 292*a* to 292*c* are coupled to each other by a second gear train 2150, which is a second drive force transmitting member. A pendulum gear 2152 is disposed at a branching part at which the main body portion and the transporting portion are separated. The pendulum gear 2152 is urged in an engaging direction by an elastic member (not shown). The pendulum gear 152 allows the transporting portion 278 to be freely drawn out in a state the main body portion 276 is attached to the image forming apparatus body 12. When the transporting portion 278 is attached, the pendulum gear 152 ensures reliable engagement.

In the embodiment, the second drive force transmitting member is constructed with the gear train. However, a force transmitting part subsequent to the pendulum gear may be replaced with a timing belt.

An operation of the fifth embodiment will be described.

The charging device 56 uniformly charges the image carrying body 44. The image carrying body 44 is illuminated with light emitted from the optical writing unit 58 in accordance with an image signal. A latent image is formed on a latent image writing position P. The light from the optical writing unit 58 passes through inside of the process cartridge 64. The latent image on the image carrying body 44 formed by the optical writing unit 58 is visualized by a developer from the developing device 60.

As shown in FIG. 10, when the paper feed cassette 22 is attached to the paper feed unit 18, one of the paper feed units 18 is selected according to a size signal or the like. Recording media contained in one of the paper feed cassettes 22 are fed out sheet by sheet by the paper feeding roll 24; the recording medium is handled by the retard roll 26 and the feed roll 28 and led to the main transporting path 32. The register roll 38 temporarily stops the recording medium. The recording medium is led to the position between the transfer device 42 and the image carrying body 44 at a proper timing.

When the recording medium is led to the position between the transfer device 42 and the image carrying body 44 in this manner, the developer is transferred from the image carrying body 44 onto the recording medium by the transfer device 42. The recording medium carrying the developer transferred thereon passes through the fixing device 36 and the sheet discharge port 34, and is discharged into the sheet discharging portion 16.

When the manual paper feeding is required, the paper feed cassette 22 is pulled out of the paper feed unit 18 and the manual paper feed unit 274 is attached to the image forming apparatus body 12 instead. The attachment of the manual paper feed unit is performed by putting the user's hand on the handle portion 286. The user first inserts the transporting portion 278 into the paper feed unit body 20. Then, the user presses the main body portion 276 against the image forming apparatus body 12 to engage the latch portions 2122*a* and 2122*b* with the latch engaging portions 2126*a* and 2126*b*, respectively so that the main body portion 276 is fixed to the image forming apparatus body 12. Thereby, the movable member 2100 comes in contact with the roll support member 296 and the pinch roll 294 abut against the feed roll 28. The first microswitch 2104 and the second microswitch 2112 inform the control unit 2110 that the manual paper feed unit 274 is attached. If the sheet is present in the paper feed tray 282, the drive motor 2146 is rotated to rotate the feed roll 2128 for manual paper feed via the first gear train 2148 and then, the sheet is separated by the separation pad 2134. The transporting rolls 292*a* to 292*c* are also rotated via the second gear train 2150. Therefore the sheet is transported through the transporting path 290 for manual paper feed and further is transported to the main transporting path 32 by the feed roll 28. An image is formed in a similar way.

For example, when paper jamming occurs in the transporting path 290 for manual paper feed, what the user has to do is to raise the paper feed tray 282, to house the paper feed tray in the tray containing portion 280, and to pull out the transporting portion 278. To remove the manual paper feed unit 274, the user first turns the latch bars 2118*a* and 2118*b* to remove the holding between the main body portion 276 and the image forming apparatus body 12, and put the user's hand on the handle portion 286 to pull out the main body portion 276 and the transporting portion 278 all at once.

In the embodiment mentioned above, the paper feed cassette 22 is replaceable with the manual paper feed unit 274. If required, a particular paper feed unit such as an envelope feeder for feeding sheets having a special size, for example, an envelope may be used in place of the paper feed cassette 22 or the manual paper feed unit 274.

In the embodiments described above, the image forming apparatus is of the electrophotography type, but maybe of the ink jet type.

As seen from the foregoing description, in the invention, the paper feed cassette is replaceable with the paper transporting unit. Accordingly, a space of the potion of the image forming apparatus body to which the paper feed cassette is attached is utilized with less waste.

What is claimed is:

1. An image forming apparatus comprising:

an image forming apparatus body;

a paper feed cassette detachably attached to the image forming apparatus body;

a paper transporting unit, which is detachably attached to the image forming apparatus body in place of the paper feed cassette; and a manual paper feed unit directly coupled to the paper transporting unit;

wherein the paper transporting unit includes transporting rolls for transporting a recording medium, and the manual paper feed unit includes a drive source for driving the transporting rolls.

2. The image forming apparatus according to claim 1, wherein the manual paper feed unit is fixed to the image forming apparatus body.

3. The image forming apparatus according to claim 1, wherein the manual paper feed unit includes:

a sheet stacking tray for stacking recording medium thereon; and a feeding roll for feeding the recording medium stacked on the sheet stacking tray; and wherein the recording medium is fed to the paper transporting unit by rotating the feeding roll.

4. The image forming apparatus according to claim 3, wherein the sheet stacking tray is rotatable about the feeding roll.

5. The image forming apparatus according to claim 1, further comprising a large capacity tray coupled to the paper transporting unit in place of the manual paper feed unit.

6. The image forming apparatus according to claim 1, further comprising a post-processor coupled to the paper transporting unit in place of the manual paper feed unit.

7. The image forming apparatus according to claim 1, further comprising a particular paper feed unit attached to the image forming apparatus body in place of the paper feed cassette.

8. The image forming apparatus according to claim 1, wherein the paper feed cassette is a plurality of paper feed cassettes arranged in a vertical direction; and wherein the paper transporting unit is attached to the image forming apparatus body in place of the paper feed cassette at the upper most stage.

9. The image forming apparatus according to claim 7, wherein when the paper transporting unit is attached to the image forming apparatus body in place of the paper feed cassette, the paper transporting unit is attached from one side of the image forming apparatus body, and the manual paper feed unit is coupled to the paper transporting unit from the one side of the image forming apparatus body.

10. The image forming apparatus according to claim 1, wherein when the paper transporting unit is attached to the image forming apparatus body in place of the paper feed cassette, the paper transporting unit is attached from one side of the image forming apparatus body, and the manual paper feed unit is coupled to the paper transporting unit from the one side of the image forming apparatus body.

* * * * *